US008020224B2

(12) United States Patent
Turnbull

(10) Patent No.: US 8,020,224 B2
(45) Date of Patent: Sep. 20, 2011

(54) INTERNAL CORNER STRUCTURE FOR MATTRESS FOUNDATIONS

(75) Inventor: Jeff Turnbull, Kannapolis, NC (US)

(73) Assignee: Sealy Technology LLC, Trinity, NC (US)

( * ) Notice: Subject to any disclaimer, the term of this patent is extended or adjusted under 35 U.S.C. 154(b) by 352 days.

(21) Appl. No.: 12/486,135

(22) Filed: Jun. 17, 2009

(65) Prior Publication Data

US 2010/0319124 A1 Dec. 23, 2010

(51) Int. Cl.
*A47C 23/00* (2006.01)

(52) U.S. Cl. ..... 5/254; 5/717; 5/261

(58) Field of Classification Search ..... 5/260–263, 5/717, 739, 254
See application file for complete search history.

(56) References Cited

U.S. PATENT DOCUMENTS 5,265,291 A * 11/1993 Callaway ..... 5/254
5,628,080 A 5/1997 Quintile
5,878,455 A 3/1999 Patterson
6,125,488 A 10/2000 Vogland et al.
6,493,887 B1 * 12/2002 DeFranks et al. ..... 5/254
6,708,357 B2 3/2004 Gaboury et al.
7,127,765 B2 10/2006 Ruiz
7,216,390 B2 5/2007 Vaskuthy

* cited by examiner

*Primary Examiner* — Fredrick Conley
(74) *Attorney, Agent, or Firm* — Roetzel & Andress

(57) ABSTRACT

An internal corner structures for mattress foundations that sit at each corner between the frame and the grid. The rigid member contains a base, body and grid support deck. The base member sits atop the foundation frame and contains two flanges that overlap the frame and guide the positioning of the internal corner structure relative to the frame. The body structure supports the grid deck and has a rounded exterior profile to provide a rounded smooth contour to the mattress foundation corners, and has a plurality of square shaped openings that extend in both a vertical and horizontal direction. The grid support deck sits atop the body structure and provides support to the mattress foundation grid, and has engagement clips that engage and position the grid and an edge guard that functions to disperse a load and protect the engagement clips from impact.

20 Claims, 5 Drawing Sheets

INTERNAL CORNER STRUCTURE FOR MATTRESS FOUNDATIONS

RELATED APPLICATIONS

There are no pending applications related to this application.

FIELD OF THE INVENTION

The present invention is in the general field of mattresses and sleep systems which have a mattress and a mattress foundation.

BACKGROUND OF THE INVENTION

Mattress foundations or "box springs" are commonly used as the support structure or system underneath a mattress, to provide the mattress with a mounting surface which is firm but which also has some degree of flexibility for responding to heavier loads. Mattress foundations have traditionally been constructed with a frame, such as a wooden frame, which supports multiple spring elements or modules which in turn support a grid or platform for the mattress. The foundation structure is covered by upholstery and other material covering and some padding. The shape of the mattress foundation is compatible with the matching mattress, i.e. planar top and bottom sides, vertical side walls and generally rounded corners at the intersections of the vertical sides. The rounded corners of the foundation present a design challenge due the general absence of structural support of the grid by the spring members at the corners. When the corners are left essentially unsupported, this leads to sagging of the foundation and the mattress in those areas. Also the absence of internal structure at the corner areas of the foundation leaves the covering or upholstery without any backing, which can lead to overstretching or wrinkling of the material and an unattractive finished appearance.

SUMMARY OF THE INVENTION

The present disclosure and related inventions provides an internal corner structure for mattress foundations which fits and cooperates with frame and grid components of a foundation to provide an improved mattress foundation. In accordance with one aspect of the disclosure, an internal mattress foundation corner has a configuration with a vertical extent, a base, a grid support deck which is vertically spaced from the mounting base, a body structure which supports the grid support deck above the base, the body structure extending substantially around a perimeter of the base and the grid support deck and having an exterior profile which includes a rounded corner which forms a rounded corner of a mattress foundation.

DETAILED DESCRIPTION OF PREFERRED AND ALTERNATE EMBODIMENTS

Figure 1:
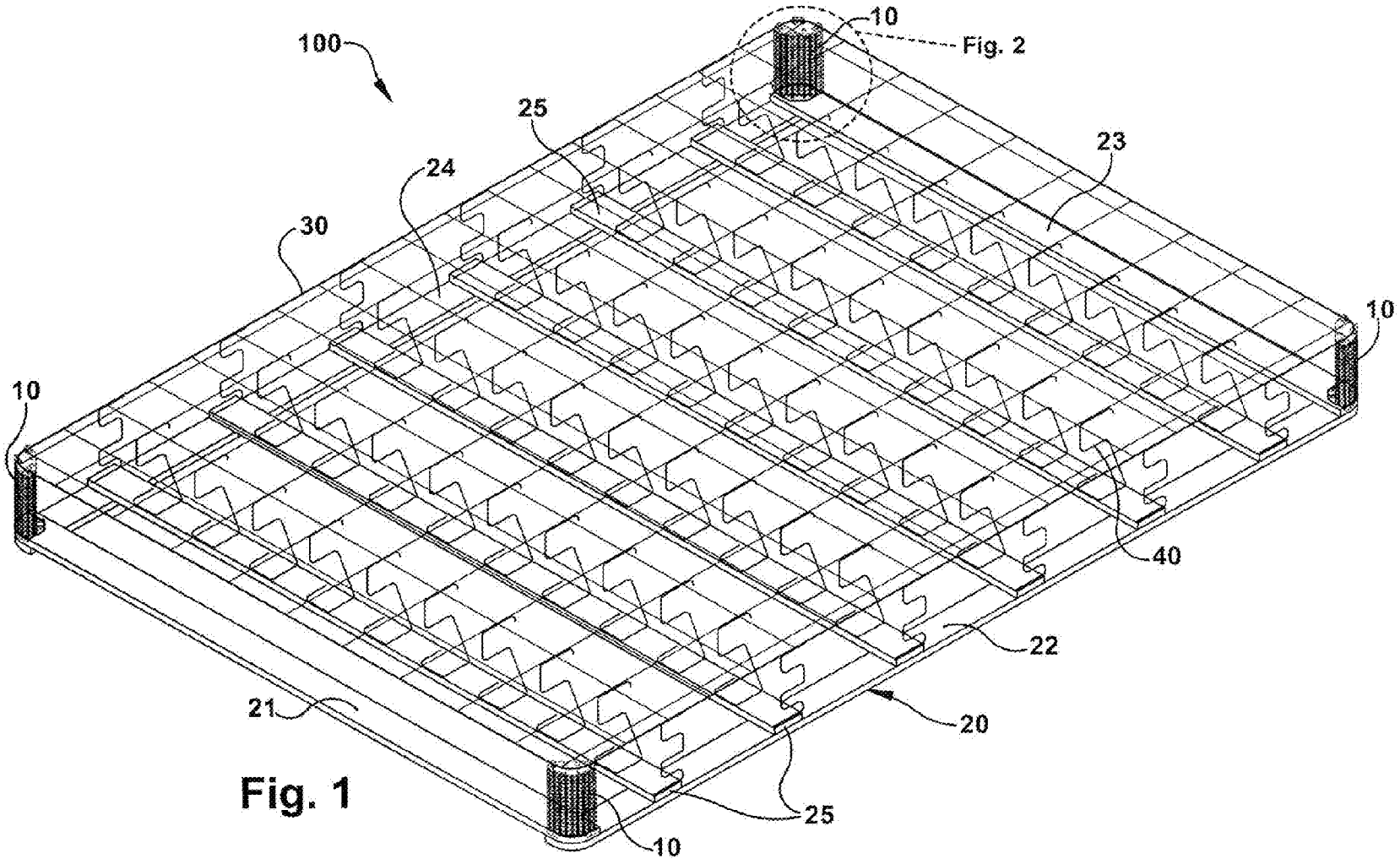
FIG. 1 is a perspective view of an innerspring with internal mattress foundation corner structures.

As illustrated in FIG. 1, the disclosure and related inventions include a mattress foundation 100, and a more specifically a mattress foundation 100 which includes internal corner structures 10 located at each corner of the generally rectangular mattress foundation 100. In addition to the internal corner structures 10, the mattress foundation 100 includes a frame 20, a grid 30 and a plurality of spring modules 40. The term "mattress foundation" generally refers to a any type of support structure or assembly which is designed to support a mattress by placement directly underneath a mattress. Mattress foundations are sometimes also referred to alternatively as "box springs". A mattress foundation 100 or box spring provides a distributed generally homogenous reflexive support system to give underlying support to an overlying mattress. The degree of flexure of a mattress foundation may vary, depending upon the type of spring structure (or lack thereof) in the mattress foundation.

The mattress foundation contains a plurality of similarly or identically formed springs which are interconnected in an array or matrix, which are known as spring modules 40. Each spring module 40 includes a body with a first end and a second end, the body of each spring being generally S-shaped and having a longitudinal axis and an outer diameter. The springs are spaced apart in the rows and columns and connected together in a spaced apart arrangement with each spring being spaced from each adjacent spring in the array and laced together by helical lacing wires (not shown) attached to the border wire of the grid. The representative spring modules 40 shown in FIG. 1 are S-shaped but a foundation 100 may contain different types of springs such as wire form coils or foam springs with varying coil or foam counts.

Figure 2:
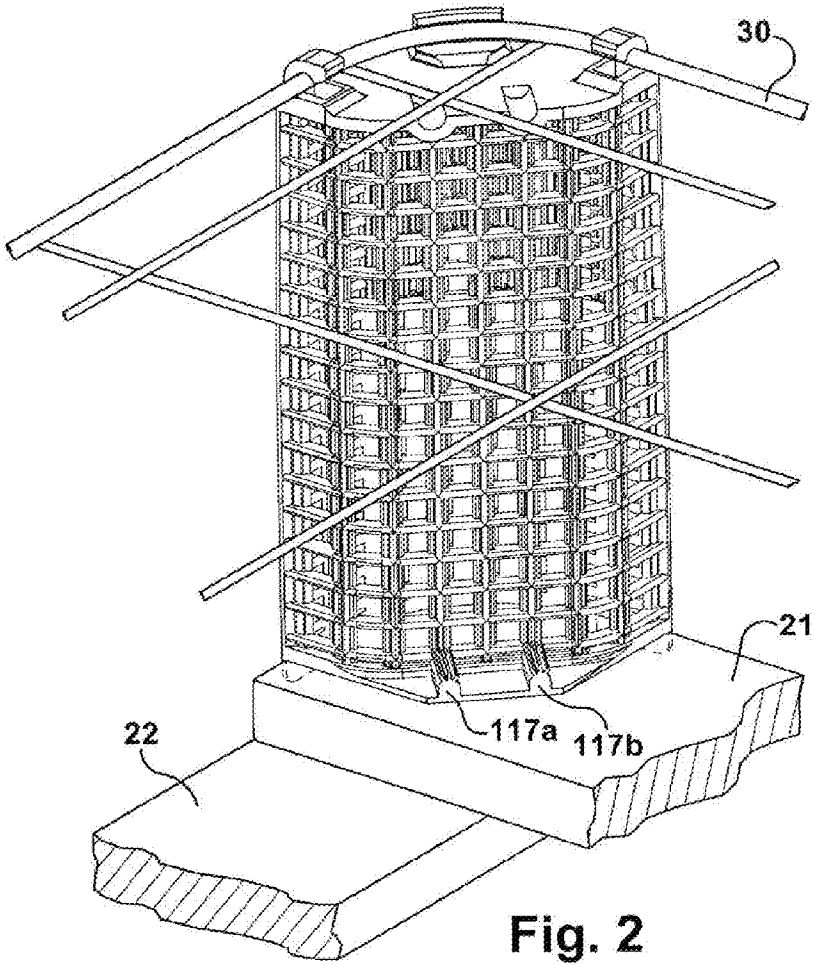
FIG. 2 is a perspective view of a corner area of a mattress foundation which includes an internal mattress foundation corner structure of the present disclosure.

The mattress foundation frame 20 is made of interconnected and intersecting frame members 21, 22, 23 and 24. The corners of the frame 20 are generally radiused about the outer perimeter through ninety degrees at an approximate radius of 1-4 inches, depending upon the overall dimensions of the frame 20 and foundation 100. Several wooden slats 25 are located between frame members 22 and 24, running parallel to frame members 21 and 23. Intersecting ends of the frame members may be overlapped, as illustrated, so that a top surface of one frame member is at a higher elevation than the top surface of the other intersecting frame member. With this particular frame configuration, the internal corner structure 10 is preferably mounted on the frame member surface at the higher or highest elevation, as shown in FIG. 2.

The internal corner structures 10 of the mattress foundation 100 sit between the frame 20 and the grid 30. In a preferred embodiment, the internal corner structure 10 is made from polypropylene, however, it can be made from any other plastic polymer suitable for injection molding. The dimensions of a representative corner structure 10 are approximately 7.8 inches high, 4.4 inches wide and 2.5 inches deep and it weighs approximately 0.19 lbs. It has an internal volume of approximately 5.79 cubic inches. The internal corner structures 10 also have a symmetrical design so that a single internal corners structure 10 can be used for all four corners of the mattress foundation 100.

Figure 3:
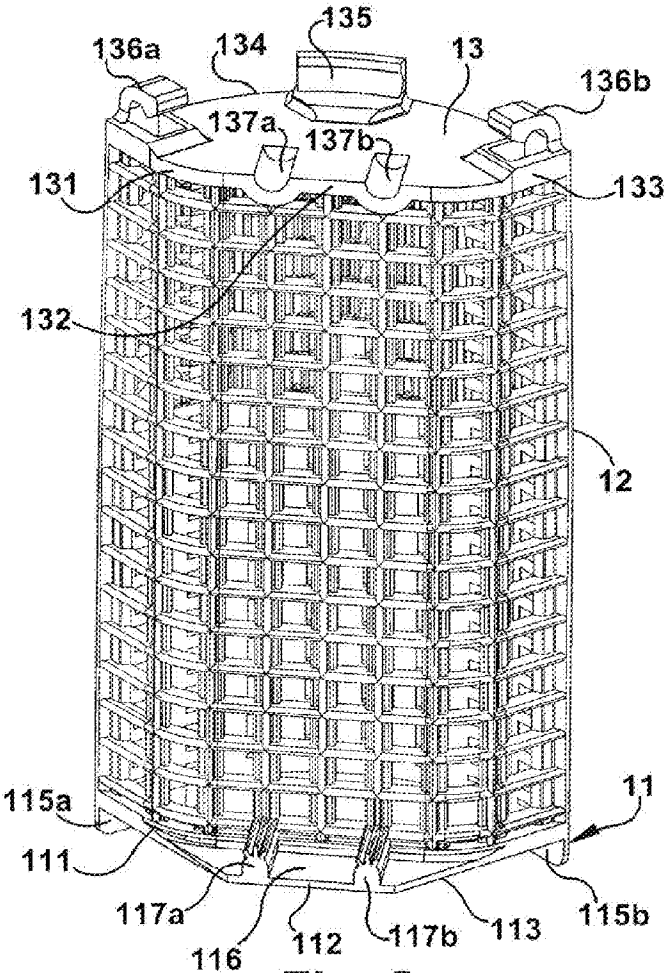
FIG. 3 is a perspective view of an internal mattress foundation corner structure.
Figure 4:
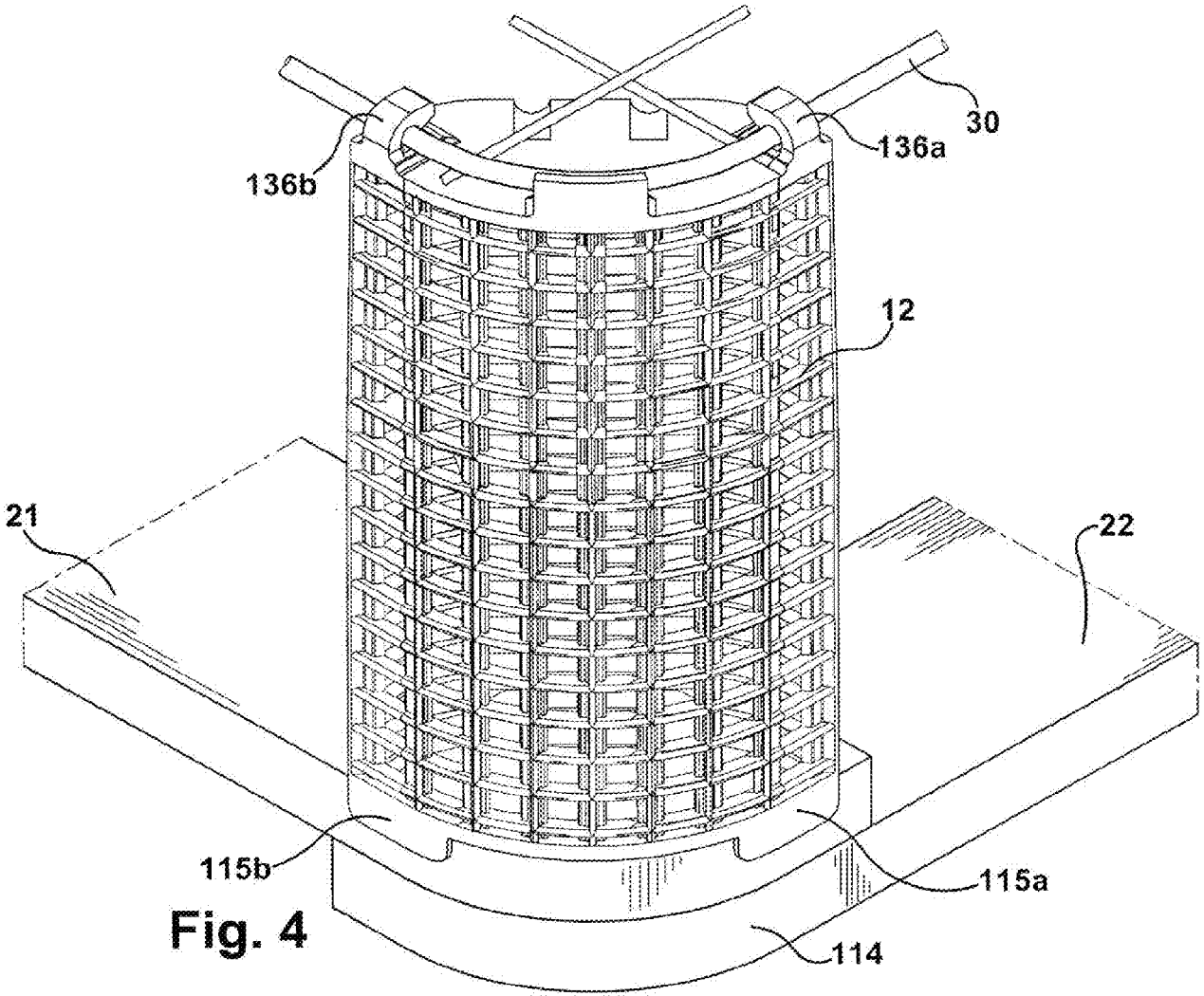
FIG. 4 is a perspective view of an internal mattress foundation corner structure, from a point of view generally opposite to that of FIG. 2, of the present disclosure.

As shown in FIG. 3, the internal corner structure 10 is made up of a base 11, a body structure 12 and a grid support deck 13. The base 11 is generally planar and dimensioned to fit within the width dimension of a top surface of the frame members. It has generally linear sides 111, 112, 113 and an arcuate transition 114 between sides 111 and 113. Two flanges 115*a*, 115*b* are located along the arcuate transition 114, one at each end. Each flange 115*a*, 115*b* extends down over the frame member, as shown in FIG. 4. The flanges 115*a*, 115*b* allow an operator to consistently position the internal corner structure 10 relative to the frame 20. The base 11 also contains a tongue 116 which is a planar member that extends out horizontally from the front of the body structure 116 and is bound by sides 111, 112, and 113. Two staple arches 117*a*, 117*b* sit parallel to each other on the tongue 116 of the base member 11. The base 11 is attached to the frame 20 through the staple arches 117*a*, 117*b* located on the tongue 116 using staples or other securing means. The staple arches 117*a*, 117*b* each contain several ridges protruding from the top surface of the arch. These ridges are intended to absorb the pressure from the impact of the staple being secured through the tongue 116 of the base member 11 and into the frame 20.

Sitting atop the base member 11, is the body structure 12. The body structure 12 supports the grid support deck 13 (discussed below) and has an exterior profile which includes a rounded corner which forms a rounded, smooth contour to the mattress foundation corners. The exterior rounded corner eliminates concavity of the border material at the foundation corners. The body 12 also provides rigid support in the corner of the mattress foundation and possesses superior strength and impact resistance. The body structure 12 has a lattice or honeycomb-type pattern made up of a plurality of square shaped openings extending both vertically and horizontally across the structure.

Figure 5:
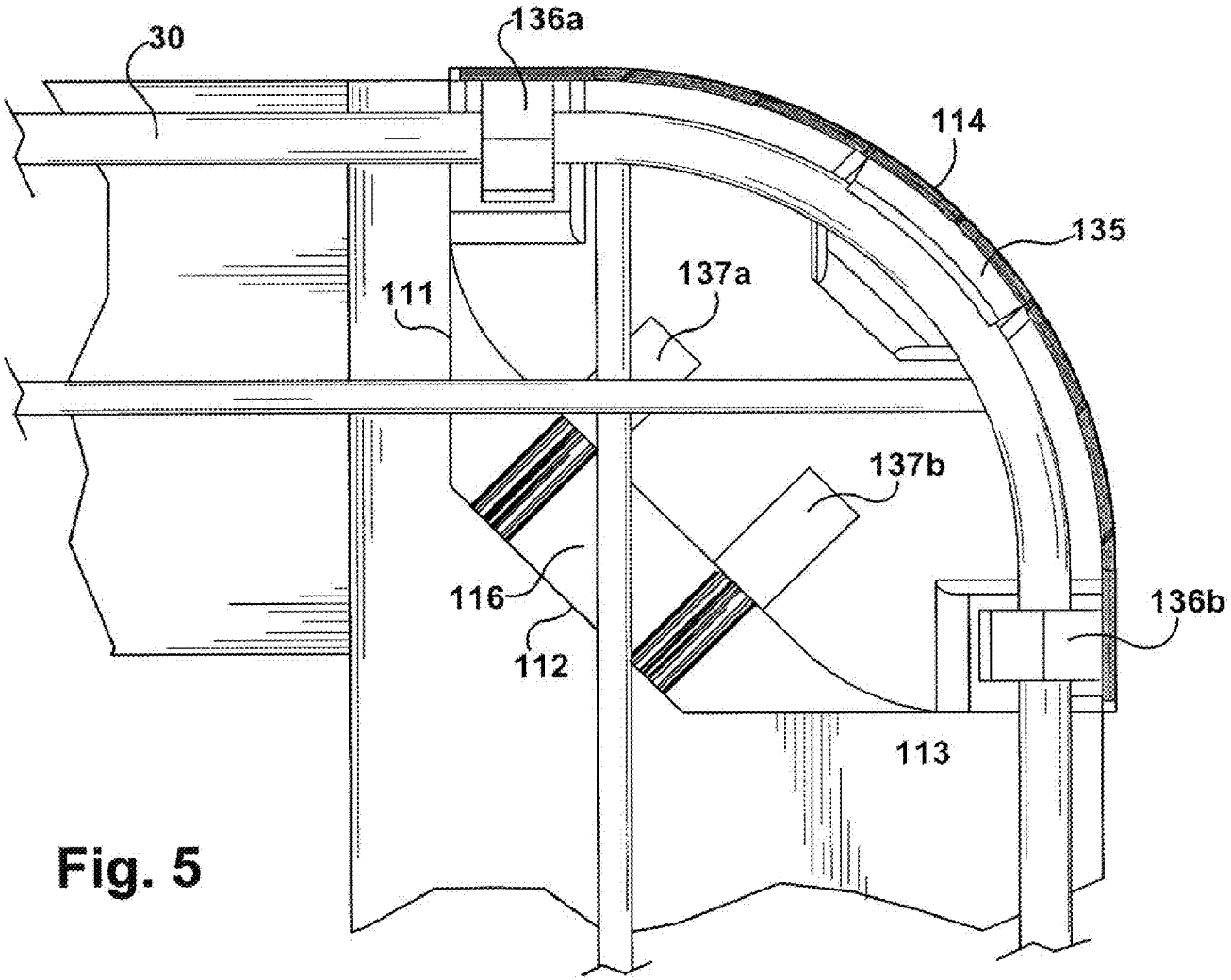
FIG. 5 is a top view of a corner area of a mattress foundation which includes an internal mattress foundation corner structure of the present disclosure.

A grid support deck 13 sits atop the body structure 12. It has a generally planar surface and is in the shape of the base member 11, containing three linear sides 131, 132, 133 and an arcuate transition 134. An edge guard 135 is located at the center of the arcuate transition 134 and functions to disperse the load and protect the engagement clips 136*a*, 136*b* should an impact occur at the corner of the guard. Two engagement clips 136*a*, 136*b* are used to position the grid 30 and are located at opposite ends of the arcuate transition 134, parallel to sides 131 and 133. Two notches 137*a*, 137*b* are located along side 132 and are used to facilitate the staple arches 117*a*, 117*b* upon nesting. The design of the grid support deck 13 makes it easy to install and secure. The border wire simply snaps into place via the two engagement clips 136*a*, 136*b* and the corner is therefore flush with the edge guard, as shown in FIG. 5.

Figure 6:
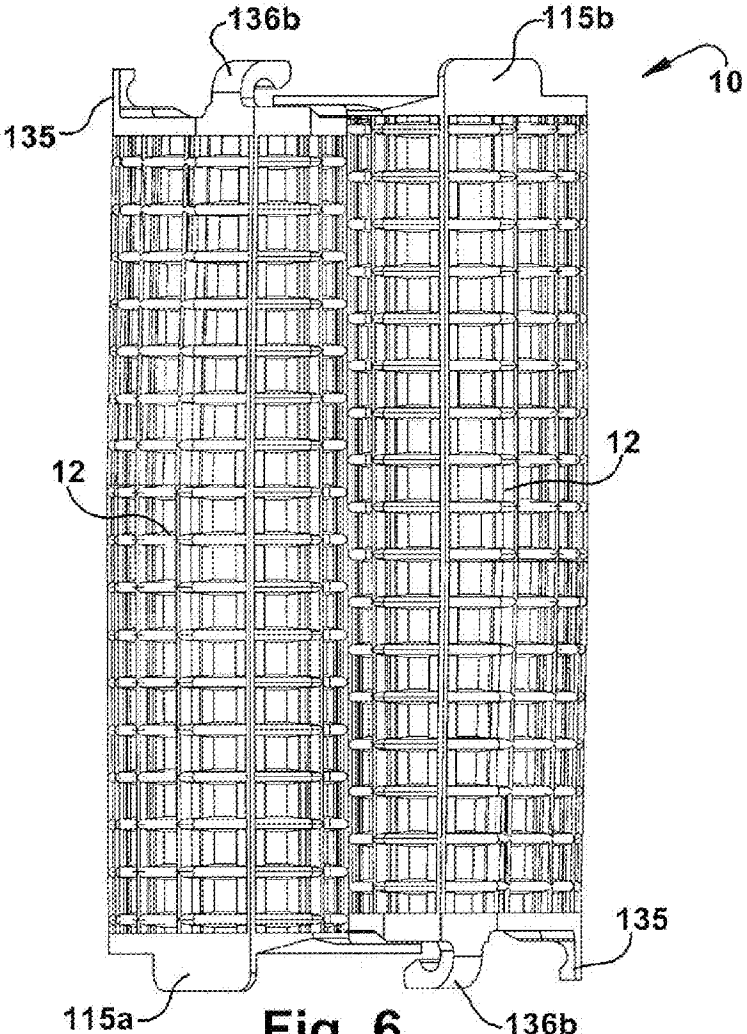
FIG. 6 is a perspective view of two nested mattress foundation corner structures.

The internal corner structures 10 are capable of interlocking or nesting. As shown in FIG. 6, one internal corner structure 10 is placed in a vertically upright position and the other internal corner structure 10 is transposed. The two notches 137*a*, 137*b* located on the grid support deck 13 of the transposed internal corner structure 10 fit directly over top of the two staple arches 117*a*, 117*b* located on the base member 11 of the upright internal corner structure 10. The flat side of the upright internal corner structure 10, which is bound by sides 112 and 132, sits flush with the flat side of the transposed internal corner structure. This arrangement reduces the volume required for shipping and storage of the internal corner structures 10.

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated.

What is claimed is:

1. A mattress foundation comprising:

a substantially rectangular frame comprised of interconnected and intersecting frame members;

a wire grid;

a plurality of similarly formed springs which are interconnected in an array or matrix and located between the frame and the grid;

four internal corner structures, one located at each corner of the frame between the frame and the grid, said internal corner structures comprising:

a generally planar base member dimensioned to fit within the width dimension of a top surface of the foundation frame members with three generally linear sides and an arcuate transition between two of the linear sides and containing two flanges located along the arcuate transition that extend down over the foundation frame member and a tongue, which is a planar member that extends horizontally from the three generally linear sides and contains two staple arches that sit parallel to each other;

a body structure located on top of the base member which has an exterior profile that includes a rounded corner and three generally linear sides with a lattice pattern made up of a plurality of square shaped openings extending both vertically and horizontally across the structure;

a grid support deck located on top of the body structure that has a generally planar surface with three linear sides and an arcuate transition between two of the linear sides and containing an edge guard located at the center of the arcuate transition, two engagement clips located at opposite ends of the arcuate transition, and two notches used to receive the two staple arches upon nesting of two corner structures.

2. The mattress foundation of claim 1 wherein the internal corner guard structure is injection molded.

3. The mattress foundation of claim 1 wherein the internal corner guard structure is made out of polypropylene.

4. The mattress foundation of claim 1 wherein the internal corner guard structure is approximately 7.8 inches high, 4.4 inches wide and 2.5 inches deep.

5. The mattress foundation of claim 1 wherein the internal corner guard structures weighs approximately 0.19 lbs.

6. The mattress foundation of claim 1 wherein the internal corner guard structure has an internal volume of approximately 5.79 cubic inches.

7. The mattress foundation of claim 1 wherein the internal corner guard structure is symmetrically designed to be used at any corner of the mattress foundation.

8. The mattress foundation of claim 1 wherein the engagement clips of the internal corner guard structure are used to position the mattress foundation grid.

9. The mattress foundation of claim 1 wherein the internal corner guard structure is capable of nesting within other corner guard structures.

10. The mattress foundation of claim 1 wherein the internal corner guards structures are stapled to the mattress foundation frame.

11. An internal corner guard structure for a mattress foundation comprising:

a generally planar base member dimensioned to fit within the width dimension of a top surface of a foundation frame with three generally linear sides and an arcuate transition between two of the linear sides, two flanges located along the arcuate transition that extend down over the foundation frame member and a tongue, which is a planar member that extends horizontally from the three generally linear sides and contains two staple arches that sit parallel to each other;

a body structure located on top of the base member, the body structure having an exterior profile that includes a rounded corner and three generally linear sides with a lattice pattern made up of a plurality of square shaped openings extending both vertically and horizontally across the structure;

a grid support deck located on top of the body structure that has a generally planar surface with three linear sides and an arcuate transition between two of the linear sides and containing an edge guard located at the center of the arcuate transition, two engagement clips located at opposite ends of the arcuate transition, and two notches used to receive the two staple arches upon nesting of two corner structures.

12. The mattress foundation of claim 11 wherein the internal corner guard structure is injection molded.

13. The mattress foundation of claim 11 wherein the internal corner guard structure is made out of polypropylene.

14. The mattress foundation of claim 11 wherein the internal corner guard structure is approximately 7.8 inches high, 4.4 inches wide and 2.5 inches deep.

15. The mattress foundation of claim 11 wherein the internal corner guard structures weighs approximately 0.19 lbs.

16. The mattress foundation of claim 11 wherein the internal corner guard structure has an internal volume of approximately 5.79 cubic inches.

17. The mattress foundation of claim 11 wherein the internal corner guard structure is symmetrically designed to be used at any corner of the mattress foundation.

18. The mattress foundation of claim 11 wherein the engagement clips of the internal corner guard structure are used to position the mattress foundation grid.

19. The mattress foundation of claim 11 wherein the internal corner guard structure is capable of nesting within other corner guard structures.

20. The mattress foundation of claim 11 wherein the internal corner guards structures are stapled to the mattress foundation frame.

* * * * *